United States Patent [19]

Erdodi et al.

[11] 4,168,995

[45] Sep. 25, 1979

[54] STEEL WIRE PATENTING PROCESS

[75] Inventors: György Erdődi; Béla Bodnár; Dezső Zolnai; István Gorondi; Laszló Kovács; György Takács, all of Miskolc, Hungary

[73] Assignee: December 4 Drótmüvek, Miskolc, Hungary

[21] Appl. No.: 684,070

[22] Filed: May 6, 1976

Related U.S. Application Data

[63] Continuation of Ser. No. 460,808, Apr. 15, 1974, abandoned.

[30] Foreign Application Priority Data

Apr. 20, 1973 [HU] Hungary ..... DE 815

[51] Int. Cl.[2] ..... C21D 9/52

[52] U.S. Cl. ..... 148/12.1; 148/15; 148/154

[58] Field of Search ..... 148/15, 18, 20, 12.1, 148/154

[56] References Cited

U.S. PATENT DOCUMENTS 2,716,079 8/1955 Wick et al. ..... 148/15

*Primary Examiner*—R. Dean

[57] ABSTRACT

Process for patenting steel wires, comprising the steps of passing steel wire substantially horizontally through a preheating tank containing a salt bath, and through a patenting tank similarly containing a salt bath; and applying an electrical potential between the tanks.

2 Claims, 3 Drawing Figures

STEEL WIRE PATENTING PROCESS

This is a continuation of application Ser. No. 460,808, filed Apr. 15, 1974, of the same inventors, titled "Process and Equipment for Patenting of Steel Wires," now abandoned.

The present invention relates to a process for patenting steel wires.

The patenting of steel wires is a heat-treating process known for some time and applied generally, which consists of an austeniting (annealing) phase and an isothermal quenching (holding) phase. Austeniting is carried out at a temperature of about 900° C. and isothermal quenching at a temperature of about 500° C.

For the practical realization of the two phases of the patenting process various solutions are known.

In the austeniting phase of patenting the steel wire (generally several parallel guided steel wires) is (are) heated to the required temperature by means of direct or indirect heating.

Furnaces of different pull-over systems are used for the indirect heating. This heating method has the common drawback that, due to the relatively low heat efficiency, the steel wire is warmed up slowly to the required temperature so that either the pull-over speed must be kept low or the linear measurement of furnace must be increased. Direct heating is disadvantegous with respect to the productivity, and indirect heating because of the costs of investment.

A further drawback of the known method is that the scaling of steel wire can be reduced but not stopped, even with the application of an intricate firing system and a protective atmosphere.

Direct heating is carried out for example by conducting current through the steel wire and utilizing the arising Joulean heat. With this method, the supply of current into the wire causes troubles. One of the known solutions utilizes a mechanical contact arrangement, the drawback of which is that it is not reliable enough, and therefore current supply is unstable.

With other known solution, current supply is provided through a metal bath (e.g. molten lead). Int this case the disadvantage is that the wires are immersed into the lead bath by interrupting their path (e.g. by means of rolls), therefore threading of the wires is difficult when starting.

Even with the above mentioned direct heating methods, the scaling of the steel wires causes troubles. The further processing of the steel wire is possible only after descaling, requiring considerable expenditures and time. The descaling is generally carried out by means of strong acids. The application of acids is associated with accidents on the one hand and is detrimental to health, on the other hand (acid fumes).

The other, isothermal quenching phase of the patenting process is generally carried out by immersing the wire into a lead or salt bath of a suitable temperature. For the immersion, deflecting (depressing) elements, e.g. rolls or rollers are used. These elements are, however, not reliable enough and render the operation of the equipment too complicated. Another drawback of this solution is that the bath gets overheated at the entrance point of the wire, therefore the required quenching is not ensured, and the wire quality is thereby deteriorated.

In order to eliminate the above difficulty, the bath is generally circulated by means of special pumps. These pumps render the equipment more intricate, and expensive and at the same time, they easily break down due to the adverse operation conditions.

The invention aims at the elimination of the drawbacks of the known solutions.

The task of the invention is the development of a process by means of which the patenting of steel wires can be carried out with a high productivity, ensuring constant and good quality, agreable working conditions, small space requirement, while the scaling of steel wires can be eliminated and a hot-forming (so called ausforming) of the steel wires becomes possible simultaneously with the patenting.

In order to achieve the set aim according to the invention, the steel wire is passed in a horizontal plane, along a linear path, through a preheating tank containing a salt bath, and then through a patenting tank containing similarly a salt bath, and a voltage is applied between the preheating tank and the patenting tank. This provides indirect resistance heating to the wire.

For the hot-forming carried out during the patenting, the section of the steel wire leaving the patenting tank is pulled suitably at a higher speed than the section entering the preheating tank.

For the realization of the process according to the invention an apparatus is preferably used which has at least one preheating tank and at least one patenting tank arranged along a straight line, the preheating tank being connected to one pole of an electrical supply, whereas the patenting tank to the other pole of the supply. Both tanks have lower and upper tanks, intersected on end plates by the path of the steel wires, and notches are made in the upper tanks at points of intersection with the wires. The tanks contain a salt bath and are interconnected through a pump.

The apparatus has suitably a first passing element, a roll, arranged along the path of the steel wire before the preheating bath, and a second passing element, such as a second roll, arranged behind the patenting bath.

A preferred embodiment of the apparatus has three parallel preheating tanks or patenting tanks, isolated from each other, which are connected to a phase each of the three-phase network, whereas the patenting tank or the preheating tank is connected to the neutral point of the network.

The pump interconnecting the lower and upper tanks is expediently a mammoth pump.

The most important advantages of the invention are as follows:

the steel wire passes breakfree through the patenting equipment, no deflecting element being required;

the heating of the steel wire is reliable and uniform due to the current supply through the salt bath;

no scale occurs on the steel wire since the adhering salt film shields it from the oxygen of the air, thus the application of a protecting atmosphere is unnecessary and the otherwise required descaling can be omitted together with all its consequences (space requirement, time demand, costs, application of acids);

the steel wire can be hot-formed simultaneously with the patenting, under favourable conditions, while the mechanical strength of the wire can be increased with the simultaneous improvement of the other mechanical and technological parameters (bending coefficient, torsional coefficient, etc.);

the hot-forming can be effected without any die;

the hot-forming of the wire without a die occurs automatically at the point where the structure is the most suitable for this purpose (where the resistance against forming is lowest);

the double-tank system—in addition to rendering possible linear passage of the wire—provides for the constant circulation of the salt bath, that is, prevents its local overheating;

the apparatus is relatively simple and safe in operation, the mammoth pumps that are employed do not contain moving parts, moreover deflecting elements immersed in the bath, a protecting atmosphere, etc. are not required.

The invention will now be described in more detail on the basis of an exemplary apparatus for practising the inventive process, shown in the enclosed drawing, where FIG. 1 is a scheme of a patenting and hot-forming apparatus in side elevation;

Figure 1:
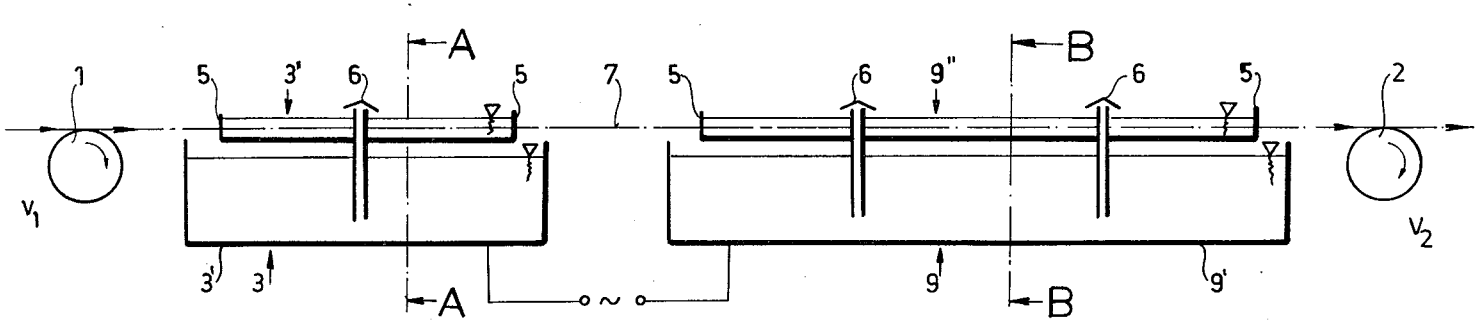
Figure 3:
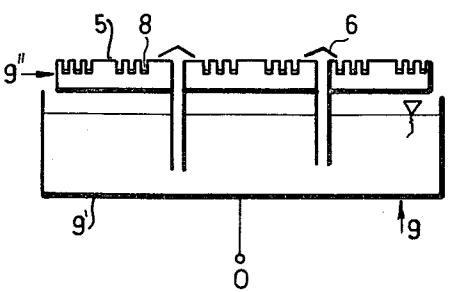
FIG. 3 is a section B—B of the apparatus of FIG. 1.
Figure 2:
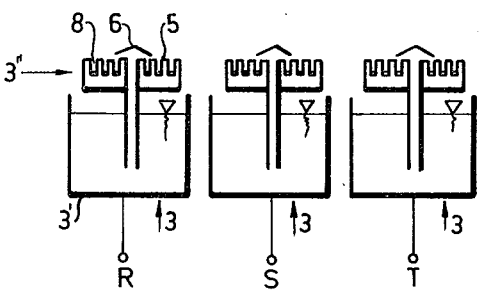
FIG. 2 shows a section A—A of the apparatus of FIG. 1.

The apparatus has a first passing element, e.g. a roll 1, arranged in a horizontal plane, along a path of parallel guided wires 7, three preheating tanks preferably 3, a patenting tank 9 and a second passing element, e.g. a roll 2. The tanks 3, 9 consist of lower tanks 3', 9' and of upper tanks 3", 9" made of metal, and provided with heating means not shown in the drawing. All the tanks are interconnected through pumps 6 that are preferably so-called mammoth pumps. On end plates 5 normal to the direction of progress of the wires 7 of the upper tanks 3" and 9" notches 8 (see FIGS. 2, 3) are made at points intersected by the path of the wires 7.

The wires are passed through the upper tanks 3", 9" in such a manner that their path is beneath the upper edges of the end plates 5 but above the lowest points of the notches 8.

The tanks are all filled with a salt bath (a salt solution or salt melt) when patenting is to be carried out. The level of the salt bath in the upper tanks is above the plane determined by the wires 7. The maintenance of this level is ensured by the suitably controlled pumps 6 renewing the salt bath from the lower tanks and flowing back through the notches 8 into the lower tanks.

The preheating tank 3 is (or tanks are) connected to one pole of an AC supply source, whereas the patenting tank 9 to the other pole of that supply source as schematically shown. This provides an indirect resistance heating to the wires 7 passing between the tanks.

For practical purposes, the preheating tank 3 may consist of three parts isolated from each other (FIG. 2), connected to a phase each R, S, T of a three-phase network, whereas the patenting tank 9 consisting of one part and is connected to the neutral point 0 of the same network. This star connection of the baths is advantageous, loading the network uniformly. The star connection can be developed, of course, also in such a manner, that the patenting bath or tank is divided into three parts. The operation of the apparatus is as follows: The wires 7 to be patented are thrown over the first roll 1, then, after being passed through the notches 8 of the upper tanks 3" of the preheating tanks 3 and of the upper tank 9" of the patenting tank 9, they are thrown also over the roll 2. The first roll 1 is rotated at a peripheral speed of $v_1$, the second roll 2 at that of $v_2$. The wires 7 respond to the respective pulling actions resulting from the peripheral speeds of the rolls.

If the wires 7 are intended to be patented only, the first and the second rolls 1, 2 are rotated at the same peripheral speed ($v_1=v_2$).

If hot-forming shall be carried out simultaneously with patenting the peripheral speed of the second roll 2 is increased as compared to that of the first roll 1, corresponding to a required extent of reduction in cross-sectional area.

The peripheral speed of the second roll 2 must not be lower at any rate than that of the first roll 1, since in this case the wires 7 would pile up in the tanks and leave their path.

When putting the apparatus into action, the pumps 6 are actuated which deliver the salt bath from the lower tanks 3', 9' into the upper tanks 3", 9". Then the voltage is applied to the tanks. The circuit of each phase R, S, T is closed to the neutral point in the following way: lower tank 3', pump 6, upper tank 3", wires 7, upper tank 9", pumps 6, and lower tank 9'.

The wires 7 warm up under the effect of the current. The warming-up is highest in the section between the upper tanks 3", 9", especially before the entrance into the tank 9". Austeniting (annealing) of the wires 7 occurs here. Before entering the upper tank 9", the wires 7 have a temperature of about 900° C., whereas after entering the salt bath, they are quenched to a temperature of about 500° C. (the temperatures are chosen depending on the wire type, according to known principles) and they remain at this temperature as long as they leave the upper tank 9" (isothermal quenching phase).

The pumps 6 continuously replace the salt bath flowing off from the upper tanks 3", and 9" and brought away by wires 7, repsectively, agitating at the same time the salt bath, preventing thereby local overheating thereof.

The wires 7 leaving the upper tank 3" are protected against scaling in the course of annealing by the adhering salt film.

If hot-forming is intended to be carried out simultaneously with patenting the speed of the second roll 2 is increased as compared to the speed of the first roll 1. Since the speed of a section of the continuous and tensioned wires 7 can be increased only by deformation, wires elongate (reduction in cross-sectional area) at a point where they are the less resistant against deformation, that is before entrance into the upper tank 9". This combined method renders possible the simultaneous carrying-out of patenting and hot-forming, this latter, however without a die.

The salt bath applied in the tanks provides for a good contact between the electrical network and the wires, for effective preheating and holding phases and, at the same time, it protects the annealed section against scaling.

It is not necessary to use the same salt bath in the preheating tank and the patenting tank, but this is advisable for the sake of simplicity. In the preheating tank, especially such salt baths can be advantageously used which have no detrimental decomposition products even at the annealing temperature (with respect especially to sanitary regulations) and which have a high conductivity.

It is not definitely necessary to use a patenting salt bath in the preheating tank, as against the patanting tank.

Experience proves that a patenting salt type 200 A, manufactured by Hertolwerk Magdeburg (German Democratic Republic) is preferable to use but other similar products may be proper as well.

The peripheral speed of the rolls, the composition and concentration of the salt bath, the current intensity, the delivery of the pumps, the heating capacity of the tanks are chosen and controlled according to prevailing requirements. The patenting tank 9 is made considerably longer, corresponding to the holding of required duration, than the preheating tank 3. The individual parts of the apparatus are of course provided with a suitable insulation for the sake of safe operation, and protection against electric shock of the operators has to be ensured.

The inventive process ensures simultaneously with patenting, even a forming of 40% (reduction in cross-sectional area) without a die, as experience shows. Meanwhile, the strength of the wire is increased, together with an improvement of other mechanical and technological parameters (bending coefficient, torsional coefficient, etc.). The wire passes linearly, without bending, through the baths, it does not scale, and is formed just where the structure is most suitable for this purpose.

What we claim is:

1. A process for patenting steel wires, comprising the steps of passing steel wires substantially horizontally, along linear wire paths, through at least one preheating tank containing a salt bath, and through at least one patenting tank similarly containing a salt bath, such baths having inherent low thermal and electrical conductivities; wherein the tanks are fitted with end plates that have notches therein for the wire paths, the end plates having upper edges while the notches have lowest points; applying an electrical potential between the preheating and the patenting tanks, and thereby indirect resistance heating to the wires; wherein said passing step is performed under the levels of the salt baths in the tanks, through the notches, the wire paths therethrough being beneath the upper edges of the end plates but above the lowest points of the notches; and keeping the levels of the salt baths in the tanks above planes defined by the wire paths.

2. The patenting process as defined in claim 1, further comprising the step of imparting pull to sections of the steel wire leaving the patenting tank at a higher speed than to a section entering the preheating tank, thereby to reduce the cross-sections of the resulting steel wires without the application of dies and the like.

* * * * *